United States Patent [19]

Mandelson et al.

[11] Patent Number: 4,617,107

[45] Date of Patent: Oct. 14, 1986

[54] PROCESS FOR THE RECOVERY OF OIL FROM SHALE

[75] Inventors: John Mandelson, Paddington; David J. McCarthy, Glen Waverley; Oto Sitnai, Mount Waverley; Alan B. Whitehead, East Brighton, all of Australia

[73] Assignee: Comonwealth Scientific and Industrial Research Organization and CSR Limited, Australia

[21] Appl. No.: 531,891

[22] PCT Filed: Sep. 30, 1982

[86] PCT No.: PCT/AU82/00162

§ 371 Date: Aug. 24, 1983

§ 102(e) Date: Aug. 24, 1983

[87] PCT Pub. No.: WO83/02283

PCT Pub. Date: Jul. 7, 1983

[30] Foreign Application Priority Data

Dec. 24, 1981 [AU] Australia ..... PF2083

[51] Int. Cl.[4] ..... C10G 1/00

[52] U.S. Cl. ..... 208/427; 208/428

[58] Field of Search ..... 208/11 R

[56] References Cited

U.S. PATENT DOCUMENTS

| | | | |
|---|---|---|---|
| 1,343,100 | 6/1920 | Thurlow | 208/11 R |
| 1,703,192 | 2/1929 | Hampton | 208/11 R |
| 2,441,386 | 5/1948 | Berg | 208/11 R |
| 3,058,904 | 10/1962 | Deering et al. | 208/11 R |
| 3,252,886 | 5/1966 | Crawford | 208/11 R |
| 3,421,868 | 1/1969 | Feldman | 208/11 R |
| 3,464,913 | 9/1969 | Berry | 208/11 R |
| 3,487,004 | 12/1969 | Berry | 208/11 R |
| 3,546,092 | 6/1968 | Whiteacre, 3rd | 208/11 R |
| 3,573,197 | 3/1971 | Gessner | 208/11 R |
| 3,784,462 | 1/1974 | Frick | 208/11 R |
| 3,976,558 | 8/1976 | Hall | 208/11 R |
| 4,061,105 | 1/1977 | Gifford, II | 208/11 R |
| 4,063,823 | 1/1977 | Baird, Jr. et al. | 208/11 R |
| 4,071,432 | 1/1978 | Knell et al. | 208/11 R |
| 4,133,381 | 1/1979 | Stewart | 208/11 R |
| 4,183,800 | 1/1980 | Mitchell et al. | 208/11 R |
| 4,389,950 | 6/1983 | Bertelsen | 208/11 R |
| 4,396,490 | 8/1983 | York | 208/11 R |
| 4,404,683 | 9/1983 | Vasalas | 208/11 R |

FOREIGN PATENT DOCUMENTS

| | | | |
|---|---|---|---|
| 561124 | 7/1958 | Canada | 208/11 R |
| 644514 | 7/1962 | Canada | 208/11 R |
| 6116783 | 9/1981 | Japan | 208/11 R |

OTHER PUBLICATIONS

"The Properties of Spent Shale," *Synthetic Fuels Data Handbook*, Hendrickson, Cameron Engines Inc., 1975, pp. 91–93.

*Primary Examiner*—Andrew H. Metz
*Assistant Examiner*—Helane Myers
*Attorney, Agent, or Firm*—Sughrue, Mion, Zinn, Macpeak & Seas

[57] ABSTRACT

A continuous process for recovery of oil and energy from oil shale. Particulate oil shale (1) is mixed with hot particulate heat carrier (2) containing free lime and retorted at conventional retorting temperatures in the presence of a purge gas (3). The purge gas comprises compounds which can react with the free lime. The mixture of spent shale and heat carrier solids (5) is separated from the product gas and vapors (4) and the solids are combusted in air (6),(7) with the optional addition of materials (8) to control the free lime content of the ash product from combustion. A stream of particles (12), extracted from the combustor is separated into a larger portion of coarser hot shale ash which is recirculated to the retorting zone as heat carrier. A smaller stream (15) is disposed of as waste after separating the energy (17) therefrom. The sensible and chemical heat from the waste solids and the sensible heat from the gases leaving the combustion zone, is recovered (J).

20 Claims, 3 Drawing Figures

PROCESS FOR THE RECOVERY OF OIL FROM SHALE

TECHNICAL FIELD

This invention relates to an improved continuous process for the recovery of hydrocarbon values, that is, oil and gaseous products, from oil shale with the simultaneous maximization of energy recovery from by-product streams.

Oil is conventionally recovered from oil shales by retorting at temperatures in the range of 400° to 600° C. The gaseous products evolved simultaneously with oil vapours during retorting comprise hydrogen and light hydrocarbons as well as impurities, such as carbon oxides and hydrogen sulphide. The solids residue after retorting contains a substantial portion of the fuel value of the original raw shale and is typically referred to as "spent shale". The oil yield and quality depends on the raw, or sometimes called fresh, shale assay and on the operating conditions in the retort. The raw shale oil must always be upgraded in one or several steps which include hydrotreatment.

BACKGROUND ART

One of the major problems with such a process is an efficient and economic manner of heat supply for oil shale retorting. Various solid and gaseous heat carriers have been proposed for retorting oil shale. Substantial dilution of the product vapours and gases from retorting occurs if the heat carrier is hot flue gas, generated for example by combustion of spent shale. Hot recycle gases such as hydrogen, beside having the above drawback, must be heated in a separate furnace using additional fuel and hence the overall thermal efficiency is decreased. Steam as a sole heat carrier is also thermally inefficient because of its high condensation heat.

Solid heat carriers have none of the above drawbacks but good mixing with raw shale must be provided in order to achieve a reasonable rate of heat transfer from the heat carrier solids to the raw shale particles. The TOSCO II process, for example, uses ceramic balls as the heat carrier which deliver their sensible heat to oil shale particles in a rotary retort. The balls must be separated from the smaller spent shale particles after retorting, usually by screening. The balls are then lifted by a mechanical elevator and heated by combustion gases, produced from burning external fuel, in a co-current moving bed heater. The raw shale particles are preheated in order to improve the thermal efficiency of the process and to minimize the expensive recirculation rate of the balls, and preheating is done in a series of dilute phase lift pipe heaters by hot gases leaving the ball heater.

The Lurgi process also uses a solid heat carrier in the form of particulate shale solids heated in a dilute phase lift pipe by partial combustion of residual carbonaceous matter. However, the residence time of solids in the pipe is short and usually only a small fraction of the fuel value of the spent shale is recovered and transferred to the heat carrier solids. Consequently, a large amount of recirculated heat carrier solids is needed to provide the necessary heat for the raw shale retorting. This can cause difficulty in controlling the quality and quantity of the oil product. Before entering the fluidized bed or moving bed retort, the two streams of solids are intensively mixed in a screw type mixer, and so the operation requires reasonable strengths of particles. For the abovementioned reasons, raw shale is also preheated by hot flue gases.

DISCLOSURE OF THE INVENTION

It is an object of this invention to provide a continuous process for the recovery of hydrocarbon values from oil shale using as a heat carrier the hot shale solids residue, which process does not have the aforementioned problems.

It has now been discovered that high yields and good quality of products, and a high thermal efficiency of the process can be achieved: by carrying out retorting in a retort in which the solids are well mixed, to which a purge gas which is also a reactant is supplied and by incorporating both the generation of a solid heat carrier and recovery of energy by combustion of spent shale in, for instance, one fluidized bed reactor, where the chemistry of the major inorganic constituents of shale, calcium and silica compounds, is advantageously utilized by selective control of the operating conditions and of the reaction environment in both the retorting and combustion zones.

It has been discovered that selective withdrawal of coarser solids from the combustion zone facilitates separation of solid wastes which are rich in sulphur compounds from the heat carrier solids and that inert solids suitable for disposal can be prepared by reacting with carbon dioxide rich gas whilst simultaneously recovering excess heat.

It has been also discovered that a substantial contribution to the retorting heat requirement can be made by control of the temperature and the composition of the atmosphere in the retort.

It has also been discovered that the retorting of raw shale, in mixtures of raw shale and particulate solids which contain free lime as either calcium oxide or calcium hydroxide, causes both the specific gravity and the sulphur content of the oil to decrease. It has further been discovered that the proper selection of retorting conditions, including selection of the chemical composition of the solids, leads to a substantial reduction in the production of acid gases and carbon monoxide during retorting.

Generally, the process of the invention comprises retorting the raw shale with a hot, recirculating, solid heat carrier which contains free lime, preferentially in a rotary retort, screw mixer retort or fluidized bed retort, preferably purged by steam, using ratios of the three inputs to achieve retorting temperatures without the need to apply external heat thereto, characterized in that: good heat transfer among particles is provided, the residence time of solids is controlled, retorting products are quickly purged out, and a significant amount of heat is generated by the reaction of steam with the lime in the solid heat carrier; separating the mixture of spent shale and heat carrier from product gases and vapours after retorting, quenching the volatile products to inhibit the progress of deleterious secondary reactions such as cracking and polymerization, and combusting the non-volatile carbonaceous residue in the mixture of spent shale and heat carrier with air in a fluidized bed combustor under controlled conditions where: the fuel value of the spent shale is efficiently utilized, the limestone and hydrated lime are decomposed, the lime or limestone-silica or silicate reactions are promoted, the sulphur in the spent shale is converted during combustion to calcium sulphite or sulphate; selectively separating the coarser particles from the combustor zone overflow as a stream of heat carrier which is then transported back to the retorting step thus closing the cycle, withdrawing the waste solids from the combustion zone and recovering the sensible and chemical heat by cooling in rotary bed steam generators in several steps and by reacting the remaining lime with a gas rich in either carbon dioxide, or steam or both.

In another aspect of the present invention, there is provision for a continuous process for the recovery of oil from raw oil shale by retorting the raw shale with a hot, recirculating, solid heat carrier containing free lime in a rotary retort, screw mixer retort or fluidized bed retort, purged by a gas rich in carbon dioxide, without the need to apply external heat thereto as described above, characterized in that: good heat transfer among particles is provided, the residence time of solids is controlled, retorting products are quickly purged out, and a significant amount of heat is generated by the reaction of carbon dioxide with lime in the heat carrier; separating the mixture of spent shale and heat carrier from product gases and vapours after retorting, quenching the volatile products as previously explained and combusting the non-volatile carbonaceous residue on the same principles disclosed above.

Preferably the process comprises mixing raw shale particles having a particle size distribution such that more than 90% by weight are under 10 mm and less than 10% by weight are under 38 μm, at a temperature from ambient to 300° C. with the heat carrier solids and steam at temperatures between 600°-900° C. in a ratio which will result in a retorting temperature of the mixture between 420°-550° C. The overall pressure in the retort but also in other main vessels is in the range 1-3 bar. The partial pressure of steam in the retort is kept at 0.1-1.0 bar and the residence time of solids between 1-30 minutes.

Excess air in the fluidized bed combustor is kept between 5-100% above the stoichiometric requirement and the average residence time of solids between 1-30 minutes.

The ratios of fuel values to calcium, calcium to silica, and calcium to total sulphur must be controlled to achieve inter alia the required temperature of the heat carrier in the combustor at 700°-900° C., to compensate for the generally endothermic calcination reactions taking place in the combustor and to convert organic sulphur compounds and sulphides to calcium sulphite or sulphate. This can be achieved by controlling additions of limestone and the quantity and quality of oil yield produced during retorting by selective absorption, on spent shale and other solids in the retort, of the high molecular weight portion of oil which is of low value due to excessive hydrogen requirement in the subsequent refining stage. The important ratios referred to above can also be controlled by regulating the addition of limestone rich solids and providing supplementary fuel to the combustor. Shale having an oil assay below the economic cut off grade for retorting is an example of a possible fuel supplement.

Regulated addition of calcium carbonate to the combustor also ensures that there is sufficient calcium in the heat carrier stream recycled to the retort to absorb sulphur compounds from the gases in the retort and for conversion to calcium hydroxide therein. The presence of sufficient calcium oxide or hydroxide in the heat carrier has been found to nearly eliminate the hydrogen sulphide, to markedly reduce the content of oxides of carbon in the retorting gas and generate heat by reaction with some species in the retort gases.

Calcium silicates can be formed when materials containing calcium carbonate, calcium oxide, free silica and various silicates are heated to temperatures above 600° C. for reaction times achieved in a fluidized bed combustor. The formation of calcium silicates partly offsets the endothermic heat of decomposition of the calcium carbonate which otherwise takes place. Therefore, control of combustion conditions to facilitate formation of silicates is thermally beneficial. Moreover, calcium silicates are environmentally inert materials reducing constraints on the solids wastes disposal methods.

The two mechanisms of heat supply for retorting described above and the several mechanisms available for control of combustion conditions, give the process the flexibility for the adjustment of process conditions which will be necessary if variations occur in a shale deposit. Another important aspect of the process is that the raw shale preheating which is expensive and inevitable in other processes is merely optional here. The process includes efficient heat recovery in a flue gas waste heat boiler and from waste solids as already described to assure energy self-sufficiency for the whole process.

The equipment preferred in the proposed process can be built in modular units and thus scale-up is facilitated.

The process has been found to be particularly applicable to shales found in the Toolebuc Formation in Queensland, Australia of which Julia Creek shale is an example. These shales are specific in that they do not disintegrate upon retorting or combustion, and therefore they are suitable as a strong particulate heat carrier. The shales from the Toolebuc Formation contain large concentrations of silica and calcium carbonate when compared with most other shales. Because of the variability in the mechanical properties of shales and the composition of the inorganic matter in them, the aforementioned process may be modified insofar as the regulation of the optimal mineral composition is concerned. For some shales the composition is favourable for converting the included sulphur into calcium sulphite or sulphate while in others some blending with or addition of high calcium carbonate bearing material may be required.

MODES FOR CARRYING OUT THE INVENTION

Figure 1:
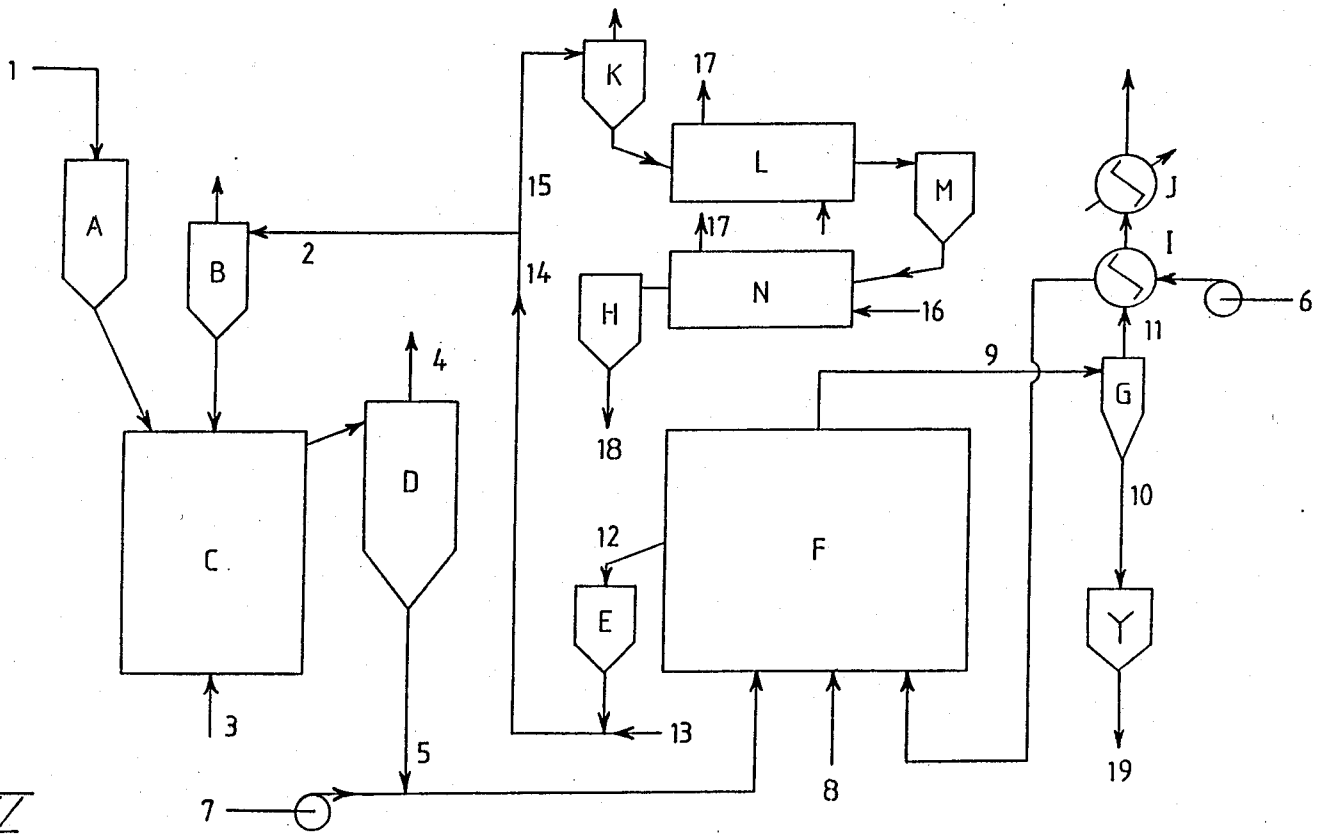
FIG. 1 is a schematic illustration of one proposed manner of carrying out the invention for one particular shale in practice.

One aspect of the present invention will now be described with reference to FIG. 1.

Raw Julia Creek shale 1 having Fischer assay 70-80 liter/tonne and particle sizes under 6 mm is fed from bin A at ambient temperature to the rotary retort C together with particles of the heat carrier 2 at 850° C. from bin B in the mass ratio 1:1.8. The retort temperature in controlled at 480° C. at its outlet. Steam 3 purges the products of pyrolysis into the separator D. Spent shale solids 5 are separated from the gaseous and volatile products 4 and the solids and air 7 are transferred to the fluidized bed combustor F. The residual carbonaceous matter on the spent shale, representing about 40% of the amount entering the process in the raw shale, is burned with 20% excess air which consists of two streams: air 7 carrying spent shale to the bed and air 6 preheated in the heat exchanger I with flue gases 11 from the fluidized bed combustor F after separation of fine carry-over particles 10 in the separators G and disposed as a waste 19 through bin Y. Sensible heat in the flue gases leaving the heat exchanger I is recovered in the waste heat boiler J. It is possible to control the temperature of the fluidized bed F at about 850° C. by (i) variation of the flow of the two streams of air 6 and 7, (ii) control of the average residence time of particles, and (iii) addition of extraneous fuel 8. The average concentration of carbonaceous matter in solids in the bed is kept at a level of about 1% by weight. The stream of particles 12, free of excessive fines, is extracted from the bed F via bin E and transported as a mixture with steam 13. The larger portion of the solids recirculates as the heat carrier stream 2 into bin B, and the smaller part 15, about 25% of the total flow 14, is disposed of as a waste 18 through bin H. Before disposal, the solids are cooled in a series of rotary coolers L, N fed through bins K, M generating steam 17. Depending on the degree of lime conversion in the bed F the excessive lime in the waste solids stream 15 may be reacted with a gas 16 rich in either carbon dioxide, or steam or both to contribute to the recovery of heat. The overall heat recovered from the waste solids is about 400 MJ per ton of raw shale feed and compares well with about 800 MJ/tonne of heat recovered in the waste heat boiler J. The overall thermal efficiency of the process (including heat losses from equipment) exceeds 70% when no external heat source is used. 95% of the carbonaceous matter entering the process is utilized and about 70 kg of raw shale oil per tone of raw shale is produced.

Features of the process are illustrated in the following examples.

EXAMPLE 1

Spent Julia Creek shale was combusted in air at 860° C. giving an ash with the following composition by weight:

Acid released $CO_2$: 1.40%
CaO: 15.3%
Organic carbon: 0.33%
Organic hydrogen: 0.05%

This ash was mixed with raw shale having the following Fischer assay values:

Oil yield: 76 liter/ton
Oil density: 961 kg/m$^3$ at 15° C.
Water yield: 35 kg/ton
Residue: 870 kg/ton
Gas make: 31.2 m$^3$/ton at 26° C.
$H_2S$ in gas: 9.0% by vol.
$CO_2$ in gas: >12% by vol.
CO in gas: 4.0% by vol.
S in oil: 3.5% by wt.

A mixture of ash and raw shale in the ratio 1:1 by weight was subjected to Fischer assay with the following results based on the mass of the mixture:

Oil yield: 38 liter/ton
Oil density: 936 kg/m$^3$ at 15° C.
Water yield: 11 kg/ton
Residue: 952 kg/ton
Gas make: 5 m$^3$/ton at 26° C.
$H_2S$ in gas: 16 ppm
$CO_2$ in gas: 0.5% by vol.
CO in gas: 0.4% by vol.
S in oil: 3.0% by wt.

EXAMPLE 2

A sample of the ash in Example 1 was hydrated and any free moisture removed by air drying at 110° C.

A mixture of hydrated ash and the raw shale described in Example 1, in the ratio 1:1 by weight was subjected to Fischer assay and gave the following results based on the mass of the mixture:

Oil yield: 38 liter/ton
Oil density: 943 kg/m$^3$ at 15° C.
Water yield: 43 liter/ton
Residue: 922 kg/ton
Gas make: 5 m$^3$/ton at 26° C.
$H_2S$ in gas: 5 ppm
$CO_2$ in gas: <0.5% by vol.
CO in gas: 1.3% by vol.
S in oil: 3.0% by wt.

EXAMPLE 3

A bulk sample of shale ash was prepared by combusting Julia Creek shale at 800° C. in air for 20 minutes. The ash had the following composition:

Acid released $CO_2$: 1.35%
CaO: 19.3%

Figure 2:
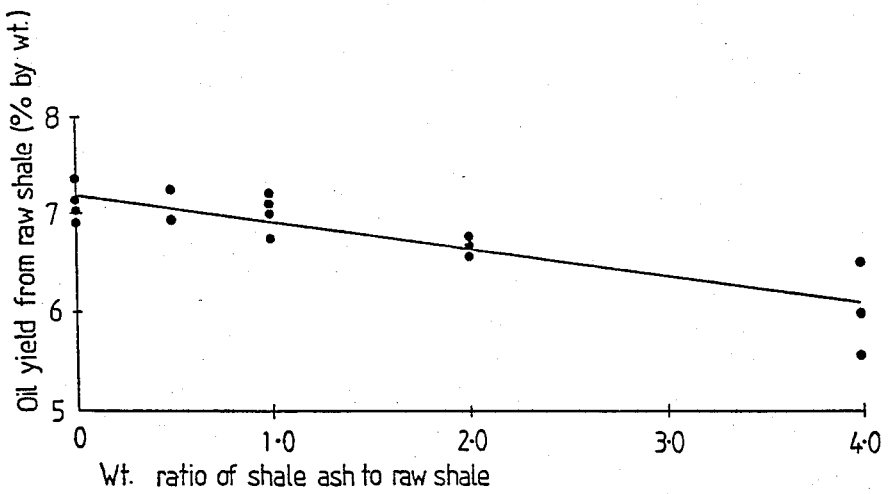
FIG. 2 is (a) a graph of oil yield from raw shale versus ratio of shale ash to raw shale, and (b) a graph of oil density versus ratio of shale ash to raw shale as described in Example 3.
Figure 2:
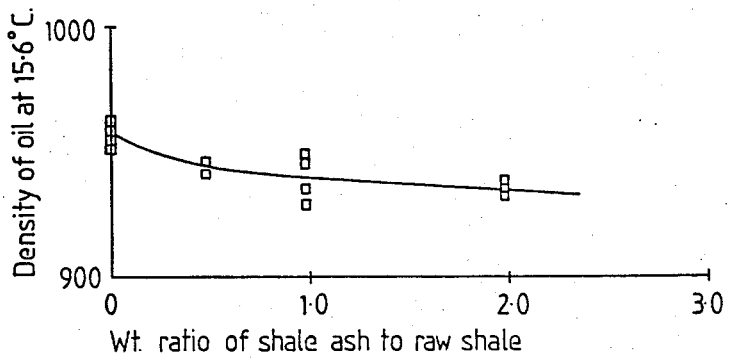

Portions of this ash were mixed with portions of the raw Julia Creek shale described in Example 1 to form a series of samples having ratios of ash to raw shale in the range 0 to 4:1. The series was subjected to Fischer assay and gave the oil yields and densities of oils which are summarized in FIG. 2.

EXAMPLE 4

Three streams, namely ash prepared from Julia Creek shale, raw Julia Creek shale and steam were mixed at the entrance of an external heated, continuous, screw conveyor retort. The proportions, by weight, of the three feed streams were: ash/raw shale/steam=5.0/1.0/0.14; and the preheat temperatures of the ash, raw shale and steam were 530° C., 230° C. and 230° C. respectively. The final retorting temperature was 490° C., the residence time of solids in the retort was 5 minutes and the mean residence time of gases and vapours was 15 s.

The shale ash contained 0.3% by wt. carbon dioxide in carbonates and 13.3% by wt. calcium oxide. The Fischer assay oil yield of the raw shale was 72 liter/tonne and the oil density was 968 kg/m$^3$.

The yields obtained by retorting, based on raw shale fed, and the salient oil properties were:

Oil yield: 65 liter/tonne
Gas make: 26.2 m$^3$/ton
$H_2S$ in gas: 0.0% by vol.
$CO_2$ in gas: 4.3% by vol.
CO in gas: 3.4% by vol.
S in oil: 3.6% by wt.

When raw shale from the same batch was retorted without admixture of either shale ash or stream but at the same temperature and at similar residence times as those used for the mixture, the following results were obtained:

Oil yield: 64 liter/ton

Gas make: 21 $m^3$/ton
$H_2S$ in gas: 8.6% by vol.
$CO_2$ in gas: 23.4% by vol.
CO in gas: 5.2% by vol.
S in oil: 5.9% by wt.

EXAMPLE 5

A sample of spent Julia Creek shale was combusted in air at 850° C. to give an ash having the following composition by weight:
Acid released $CO_2$: 5.1%
CaO: 12.2%

This ash was brought to 500° C. in air and then contacted with steam at ambient pressure and a temperature of 500° C. The free lime was fully hydrated after being exposed to steam for time intervals of 3 minutes or longer.

EXAMPLE 6

The reference sample for a differential thermal analysis experiment was made by mixing one part of raw shale, as described in Example 1, with 1.2 parts of a reference ash of low free lime content and in which the free lime was present as calcium hydroxide. The composition, by weight, of the reference ash was:
Total calcium: 27.8%
$CaCO_3$: 0.3%
$Ca(OH)_2$: 8.1%

The test sample for the differential thermal analysis experiment was made by mixing one part of raw shale, as described in Example 1, with 1.2 parts of a shale ash of relatively high free lime content, and in the preparation of which great care was taken to ensure that the free lime was in the form of calcium oxide and not calcium hydroxide. The composition by weight of the ash used for making the test sample was:
Total calcium: 27.9%
$CaCO_3$: 4.0%
CaO: 18.9%

Figure 3:
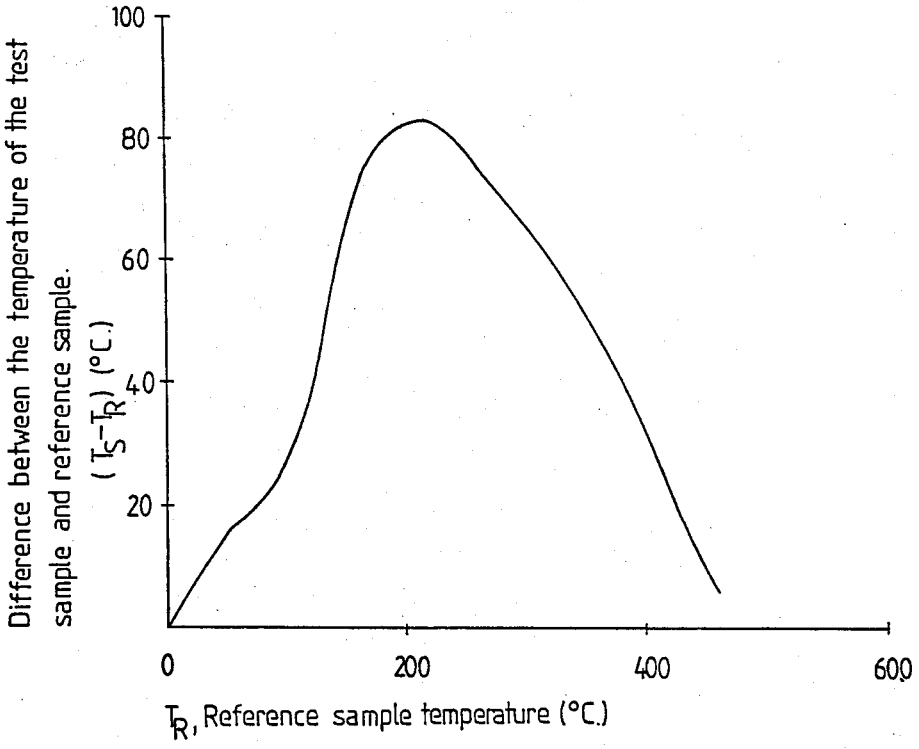
FIG. 3 is a graph of temperature differential between test and reference samples versus reference temperature sample as described in Example 6.

Both the reference sample and the test sample were retorted in high purity nitrogen. The results in FIG. 3 show the effects of the exothermic reaction between the water released from the fresh shale during retorting the calcium oxide in the test sample and the differential effect of the exothermic reaction between the carbon dioxide released from the fresh shale during retorting and the calcium oxide or hydroxide in the samples. In FIG. 3, $T_S$ denotes the temperature of the test sample and $T_R$ denotes the reference sample temperature. Temperatures were measured at the centres of the samples.

EXAMPLE 7

A sample of spent shale from Julia Creek having the following analysis by weight:
Organic carbon: 7.8%
Organic hydrogen: 0.5%
Total calcium: 20.7%
Acid released $CO_2$: 21.5%

That is, 94.5% of the calcium was in the form of calcium carbonate. The sample was heated in air at 850° C. for 0.5 hours, and the product ash contained CaO and $CaCO_3$ which accounted for only 39.3% of the calcium in the spent shale. The remainder had been converted to calcium silicates.

EXAMPLE 8

Spent Julia Creek shale as described in Example 7 was burned in 20% excess air at 860° C. in a continuous fluidized bed reactor in which the mean residence time of solids in the size range 0.85–6.2 mm was 15 minutes. The analysis of the product ash in the size range 0.85–6.2 mm showed that 95% of the fuel in the fraction has been burned, that 57.3% of the calcium in the spent shale fed had been converted to calcium silicates and the course ash fraction contained 8.6% by weight of calcium oxide.

We claim:

1. A continuous process for the recovery of hydrocarbon values from oil shale with the simultaneous recovery of energy from by-product streams, comprising the steps of:
   (a) retorting said shale by intimately mixing particulate oil shale with a process derived hot particulate heat carrier ash containing free lime in the form of calcium oxide or hydrated calcium oxide to produce additional heat, to clean the product gases, and to convert the reacted gases to solid phases;
   the temperatures and relative ratios of the shale, the heat carrier ash, and purge gas upon introduction into the retorting zone being selected so that the outlet temperature of the mixture of solids upon retorting is within the range of conventional retorting temperatures;
   (b) separating the mixture of spent shale and heat carrier solids from the product gases and vapours containing the desired hydrocarbon values;
   (c) producing the heat carrier ash having a calcium oxide content and a temperature required for use in the retorting zone, said heat carrier ash being produced in a combustion zone by:
      (i) burning the carbonaceous residues or solids from the retorting zone in admixture with controlled quantities of extraneously added solids and gases containing free lime,
      (ii) controlling the average residence times of the phases while also maintaining the combustion temperature within a range which allows for sulphur capture, or
      (iii) employing a combination of (i) and (ii);
   (d) separating a portion of the coarser hot shale ash from the solids leaving the combustion zone and recirculating this hot stream of solids to the retorting zone as the heat carrier; and
   (e) recovering the sensible and chemical heat from the waste solids and the sensible heat from the gases leaving the combustion zone;
   wherein the purge gas for retorting contains steam, and in which a substantial part of the heat required for retorting is supplied by reaction of the steam with the lime contained in the heat carrier solids, while maintaining the retorting temperature at a level below 520° C. and the partial pressure of steam in the range of 0.1–1.0 bar.

2. A process as claimed in claim 1, wherein the particulate oil shale and the solid heat carrier have temperatures, respectively, within the ranges of ambient to 300° C. and 600° to 900° C. upon introduction into the retorting zone.

3. A process as claimed in claim 1 or claim 2, wherein the particulate oil shale introduced into the retorting zone has a particle size distribution such that more than 90% by weight are under 10 mm and less than 10% by weight are under 38 μm.

4. A process as claimed in claim 1, wherein the particulate heat carrier introduced into the retorting zone contains from 2 to 50% by weight of lime as calcium oxide.

5. A process as claimed in claim 1, wherein retorting is carried out at a total pressure between 1 and 3 bar.

6. A process as claimed in claim 1, wherein steam, carbon dioxide, recycled retort gas, hydrogen, or mixtures thereof are major components of the gas supplied to the retorting zone.

7. A process as claimed in claim 1, wherein the average residence time of the solids in the retorting zone is from 2 to 30 minutes and the residence time of the gases and vapours is less than 150 seconds.

8. A process as claimed in claim 1, wherein the product gases and vapours are quenched to a temperature less than 400° C.

9. A process as claimed in claim 1, wherein the combustion temperature is within the range of 700° to 950° C. and the average residence time of the solids in the combustion zone is within the range of 1 to 30 minutes.

10. A process as claimed in claim 1, wherein the portion of hot shale ash separated from the waste solids has a particle size distribution such that more than 80% by weight is larger than 200 μm.

11. A process as claimed in claim 1, wherein the oil shale is a shale from the Toolebuc Formation.

12. A process as claimed in claim 1, wherein a substantial part of the heat required for retorting is supplied by the reaction of carbon dioxide, added to the purge gas used for retorting, with the lime contained in the heat carrier solids.

13. A process as claimed in claim 12, wherein the hydrogen sulphide content of the product gas from retorting and the total sulphur content of the oil produced by retorting are both reduced and the density of the oil is lowered, by maintaining the weight ratio of calcium oxide in the total particulate solids in the retorting zone in excess of that required for reaction with carbon dioxide to the total sulphur in the fresh oil shale in the range 1–7.

14. A process as claimed in claim 1, wherein both the hydrogen sulphide content of the product gas from retorting and the total sulphur content of the oil produced by retorting are reduced and also the density of the oil is lowered, by maintaining the weight ratio of free calcium oxide in the ash heat carrier to the total sulphur in the fresh shale in the range 1 to 80.

15. A process as claimed in claim 1, wherein the contents of carbon dioxide and carbon monoxide in the product gas from retorting are reduced by maintaining the weight ratio of calcium oxide in the ash heat carrier to the total organic oxygen in the fresh shale in the region 1 to 40.

16. A process as claimed in claim 15 for fresh shales which contain insufficient calcium oxide, hydroxide or carbonate to produce the required calcium oxide content of the shale ash heat carrier, by adding particulate solids which can form such calcium compounds of the same size distribution as the fresh shale, to the combustion zone.

17. A process as defined in claim 16 for shales from which the mixtures of shale ash and spent shale entering the combustion zone are too fuel deficient to achieve the required properties of the recirculated heat carrier ash, by adding extraneous fuel to the combustion zone, said fuel selected from the group consisting of solid fuels produced in the processes used for upgrading the oil from retorting, residual oil from the upgrading processes, hydrocarbon gases, hydrogen sulphide, low grade shale, coal, coke, char, tars, and combinations of these fuels, and then operating the combustion zone such that the air entering the combustion zone is at a rate between 5 and 100% greater than the stoichiometric requirement, and is at a mean temperature between ambient and 500° C., and to which the mixture of spent shale and shale ash enters at a temperature between ambient and 550° C. and the pressure within the combustion zone is between 1 and 3 bar.

18. A process as claimed in claim 1, wherein a substantial part of the heat required for retorting is supplied by the reaction of carbon dioxide, added to the purge gas used for retorting, with lime contained in the heat carrier solids, the hydrogen sulphide content of the product gas from retorting and the total sulphur content of the oil produced by retorting are both reduced and the density of the oil is lowered, by maintaining the weight ratio of calcium oxide in the total particulate solids in the retorting zone in excess of that required for reaction with carbon dioxide to the total sulphur in the fresh oil shale in the range 1–7 and wherein the required calcium oxide content of the shale ash heat carrier is produced from a fresh sale feedstock having desired ratios of calcium to silica, calcium to fuel and calcium to sulphur, by operating the combustion zone such that the air entering the combustion zone is at a rate between 5 and 100% greater than the stoichiometric requirement, and is at a mean temperature between ambient and 500° C., and to which the mixture of spent shale and shale ash enters at a temperature between ambient and 550° C. and the pressure within the combustion zone is between 1 and 3 bar.

19. A process as claimed in claim 1, wherein both the hydrogen sulphide content of the product gas from retorting and the total sulphur content of the oil produced by retorting are reduced and also the density of the oil is lowered, by maintaining the weight ratio of free calcium oxide in the ash heat carrier to the total sulphur in the fresh shale in the range 1 to 80, wherein the contents of carbon dioxide and carbon monoxide in the product gas from retorting are reduced by maintaining the weight ratio of calcium oxide in the ash heat carrier to the total organic oxygen in the fresh shale in the region 1 to 40, and wherein the required calcium oxide content of the shale ash heat carrier is produced from a fresh shale feedstock having desired ratios of calcium to silica, calcium to fuel and calcium to sulphur, by operating the combustion zone such that the air entering the combustion zone is at a rate between 5 and 100% greater than the stoichiometric requirement, and is at a mean temperature between ambient and 500° C., and to which the mixture of spent shale and shale ash enters at a temperature between ambient and 550° C. and the pressure within the combustion zone is between 1 and 3 bar.

20. A continuous process for the recovery of hydrocarbon values from oil shale with the simultaneous recovery of energy from by-product streams, comprising the steps of:

(a) retorting said shale by intimately mixing particulate oil shale with a process derived hot particulate heat carrier ash containing free lime in the form of calcium oxide or hydrated calcium oxide to produce additional heat, to clean the product gases, and to convert the reacted gases to solid phases;

the temperatures and relative ratios of the shale, the heat carrier ash, and purge gas upon introduction into the retorting zone being selected so that the outlet temperature of the mixture of solids upon retorting is within the range of conventional retorting temperatures;

(b) separating the mixture of spent shale and heat carrier solids from the product gases and vapours containing the desired hydrocarbon values;

(c) producing the heat carrier ash having a calcium oxide content and a temperature required for use in the retorting zone, said heat carrier ash being produced in a combustion zone by:

(i) burning the carbonaceous residues or solids from the retorting zone in admixture with controlled quantities of extraneously added solids and gases containing free lime, (ii) controlling the average residence times of the phases while also maintaining the combustion temperature within a range which allows for sulphur capture, or (iii) employing a combination of (i) and (ii);

(d) separating a portion of the coarser hot shale ash from the solids leaving the combustion zone and recirculating this hot stream of solids to the retorting zone as the heat carrier; and (e) recovering the sensible and chemical heat from the waste solids and the sensible heat from the gases leaving the combustion zone, wherein a substantial part of the heat required for retorting is supplied by the reaction of carbon dioxide, added to the purge gas used for retorting, with the lime contained in the heat carrier solids.

* * * * *